US007901734B2

(12) United States Patent
Furukawa et al.

(10) Patent No.: US 7,901,734 B2
(45) Date of Patent: Mar. 8, 2011

(54) METHOD OF MANUFACTURING NOZZLE PLATE

(75) Inventors: Gentaro Furukawa, Kanagawa (JP); Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 1325 days.

(21) Appl. No.: 11/437,615

(22) Filed: May 22, 2006

(65) Prior Publication Data

US 2006/0263535 A1 Nov. 23, 2006

(30) Foreign Application Priority Data

May 23, 2005 (JP) ..... 2005-149740

(51) Int. Cl.
*B05D 7/22* (2006.01)
*B41J 2/16* (2006.01)

(52) U.S. Cl. ..... 427/230

(58) Field of Classification Search ..... 427/230–239; 347/47

See application file for complete search history.

(56) References Cited

U.S. PATENT DOCUMENTS

| | | | | |
|---|---|---|---|---|
| 5,759,421 | A * | 6/1998 | Takemoto et al. | 216/27 |
| 6,511,156 | B1 * | 1/2003 | Kazama et al. | 347/47 |
| 7,334,872 | B2 * | 2/2008 | Kobayashi et al. | 347/47 |

FOREIGN PATENT DOCUMENTS

| | | | |
|---|---|---|---|
| JP | 9-76492 | A | 3/1997 |
| JP | 10-217482 | A * | 8/1998 |
| JP | 2002-187267 | A | 7/2002 |

* cited by examiner

*Primary Examiner* — William P Fletcher, III
(74) *Attorney, Agent, or Firm* — Birch, Stewart, Kolasch & Birch, LLP

(57) ABSTRACT

The method manufactures a nozzle plate having nozzle orifices for ejecting liquid droplets. The method comprises: a hole forming step of forming holes in a nozzle forming substrate, each of the holes passing through the nozzle forming substrate and having openings on a surface of a liquid droplet ejection side and a surface of a side opposite thereto of the nozzle forming substrate, the holes having a larger diameter than the nozzle orifices; a liquid-philic film forming step of forming a liquid-philic film on inner walls of the holes, the liquid-philic film blocking at least a portion of each of the holes; a liquid-repelling film forming step of forming a liquid-repelling film on the surface of the liquid droplet ejection side of the nozzle forming substrate, after performing the liquid-philic film forming step; and a nozzle orifice forming step of forming the nozzle orifices in the holes that are filled with the liquid-repelling film, after performing the liquid-repelling film forming step.

7 Claims, 6 Drawing Sheets

METHOD OF MANUFACTURING NOZZLE PLATE

BACKGROUND OF THE INVENTION

1. Field of the Invention

The present invention relates to a method of manufacturing a nozzle plate, and more particularly, to a method of manufacturing a nozzle plate of which surface is covered with a liquid-repelling film on the liquid droplet ejection side.

2. Description of the Related Art

There are inkjet recording apparatuses, which form an image on a recording medium by ejecting ink droplets from nozzles formed on a print head, while moving the print head and the recording medium relatively with respect to each other. The print head has a nozzle plate formed with the nozzles (nozzle orifices) on a surface opposing the recording medium.

In the inkjet recording apparatus of this kind, it is known that, in order to stabilize the meniscus of the ink in the nozzle and to prevent adherence of ink droplets and soiling to the surface of the nozzle plate (ink droplet ejection surface), a liquid-repelling film is formed on the surface of the nozzle plate. In a method of manufacturing a nozzle plate of this kind, it is necessary to fill the nozzle orifices with resist.

For example, Japanese Patent Application Publication No. 09-076492 discloses a method of manufacturing a nozzle plate in which a dry film resist of an anticorrosive high polymer resin, such as a photosensitive film, is filled into the nozzle orifices formed in a nozzle forming substrate, whereupon the dry film resist is made to project by cutting the surface of the nozzle forming substrate by an etching process, and an ink-repelling surface treatment layer is then formed, whereupon the dry film resist is removed.

Japanese Patent Application Publication No. 2002-187267 discloses a method of manufacturing a nozzle plate in which a liquid-repelling film is formed on the whole surface of a nozzle forming substrate formed with nozzle orifices, whereupon a photosensitive dry film resist is applied onto the front surface of the nozzle forming substrate and onto the faces from the front surface to the positions where the meniscus is formed on the inner walls of the nozzle orifices, the unmasked liquid-repelling film is removed by etching, a liquid-philic film is formed onto the rear surface of the nozzle forming substrate and onto the inner walls of the nozzle orifices from which the liquid-repelling film has been removed, and the photosensitive dry film resist is then removed. According to this method, the liquid-repelling film is formed on the nozzle plate surface and the faces from the nozzle plate surface to the positions where the meniscus is formed on the inner walls of the nozzle orifices, whereas the liquid-philic film is formed on the rear surface of the nozzle plate and the faces from the rear surface to the positions where the meniscus is formed on the inner walls of the nozzle orifices.

In the present specification, the term "liquid-philic" means "having a strong affinity for the liquid (e.g., the ink)". For example, in the case where the liquid or the ink is an aqueous solution or water-based, the term "liquid-philic" corresponds to "hydrophilic". On the other hand, in the case where the liquid or the ink is an oleaginous solution or oil-based, the term "liquid-philic" corresponds to "oleophilic".

However, if a resist is used as in the methods disclosed in Japanese Patent Application Publication Nos. 09-076492 and 2002-187267, then a problem arises in the stage of removing resist after forming the liquid-repelling film.

More specifically, in the case of a wet method which dissolves the resist by means of a solvent, such as an organic solvent, sulfuric acid and hydrogen peroxide, or the like, it is necessary to form a liquid-repelling film having resistance to organic chemicals, and this method is undesirable from the viewpoint of environmental safety. Furthermore, in the case of a dry method which removes the resist by means of decomposition by burning by means of plasma, it is difficult to remove completely the resist inside the nozzle orifices and nozzle blockage may occur as a result of residual resist.

SUMMARY OF THE INVENTION

The present invention has been contrived in view of these circumstances, an object thereof being to provide a method of manufacturing a nozzle plate whereby a nozzle plate having a liquid-repelling film formed on the front surface of the liquid droplet ejection side is manufactured by means of a simple manufacturing process, without using resist.

In order to attain the aforementioned object, the present invention is directed to a method of manufacturing a nozzle plate having nozzle orifices for ejecting liquid droplets, the method comprising: a hole forming step of forming holes in a nozzle forming substrate, each of the holes passing through the nozzle forming substrate and having openings on a surface of a liquid droplet ejection side and a surface of a side opposite thereto of the nozzle forming substrate, the holes having a larger diameter than the nozzle orifices; a liquid-philic film forming step of forming a liquid-philic film on inner walls of the holes, the liquid-philic film blocking at least a portion of each of the holes; a liquid-repelling film forming step of forming a liquid-repelling film on the surface of the liquid droplet ejection side of the nozzle forming substrate, after performing the liquid-philic film forming step; and a nozzle orifice forming step of forming the nozzle orifices in the holes that are filled with the liquid-repelling film, after performing the liquid-repelling film forming step.

According to the present invention, it is possible to manufacture the nozzle plate in which the surface on the liquid droplet ejection side is covered with the liquid-repelling film, and the inner walls of the nozzle orifices are covered with the liquid-philic film, by means of a simple manufacturing process. Furthermore, since no resist is used, then nozzle blockage as a result of residual resist inside the nozzle orifices does not occur. Moreover, since the nozzle orifices are formed after forming the liquid-philic film in the holes having the larger diameter than the nozzle orifices, then it is possible to form the nozzle orifices of very fine diameter, with a high degree of accuracy.

Preferably, the liquid-philic film forming step includes a step of forming the liquid-philic film on the surface of the liquid droplet ejection side of the nozzle forming substrate.

According to this aspect of the present invention, the liquid-philic film forming step is facilitated.

Preferably, the liquid-philic film forming step includes a step of forming the liquid-philic film on the surface of the liquid droplet ejection side and the surface of the side opposite thereto of the nozzle forming substrate.

According to this aspect of the present invention, the liquid-philic film forming step is further facilitated. Furthermore, it is also possible to use the liquid-philic film that is formed on the rear surface of the nozzle forming substrate on the opposite side to the liquid droplet ejection side, as an agent for bonding the nozzle forming substrate to another plate member.

Preferably, the method further comprises a liquid-philic film removal step of removing the liquid-philic film formed on the surface of the liquid droplet ejection side of the nozzle forming substrate, before performing the liquid-repelling film forming step.

According to this aspect of the present invention, non-uniformity of thickness is prevented in the liquid-repelling film formed on the surface of the liquid droplet ejection side of the nozzle forming substrate.

Preferably, the liquid-philic film removal step includes a step of roughening the surface of the liquid droplet ejection side of the nozzle forming substrate.

According to this aspect of the present invention, bonding characteristics and liquid-repelling characteristics are improved in the liquid-repelling film formed on the surface of the liquid droplet ejection side of the nozzle forming substrate.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
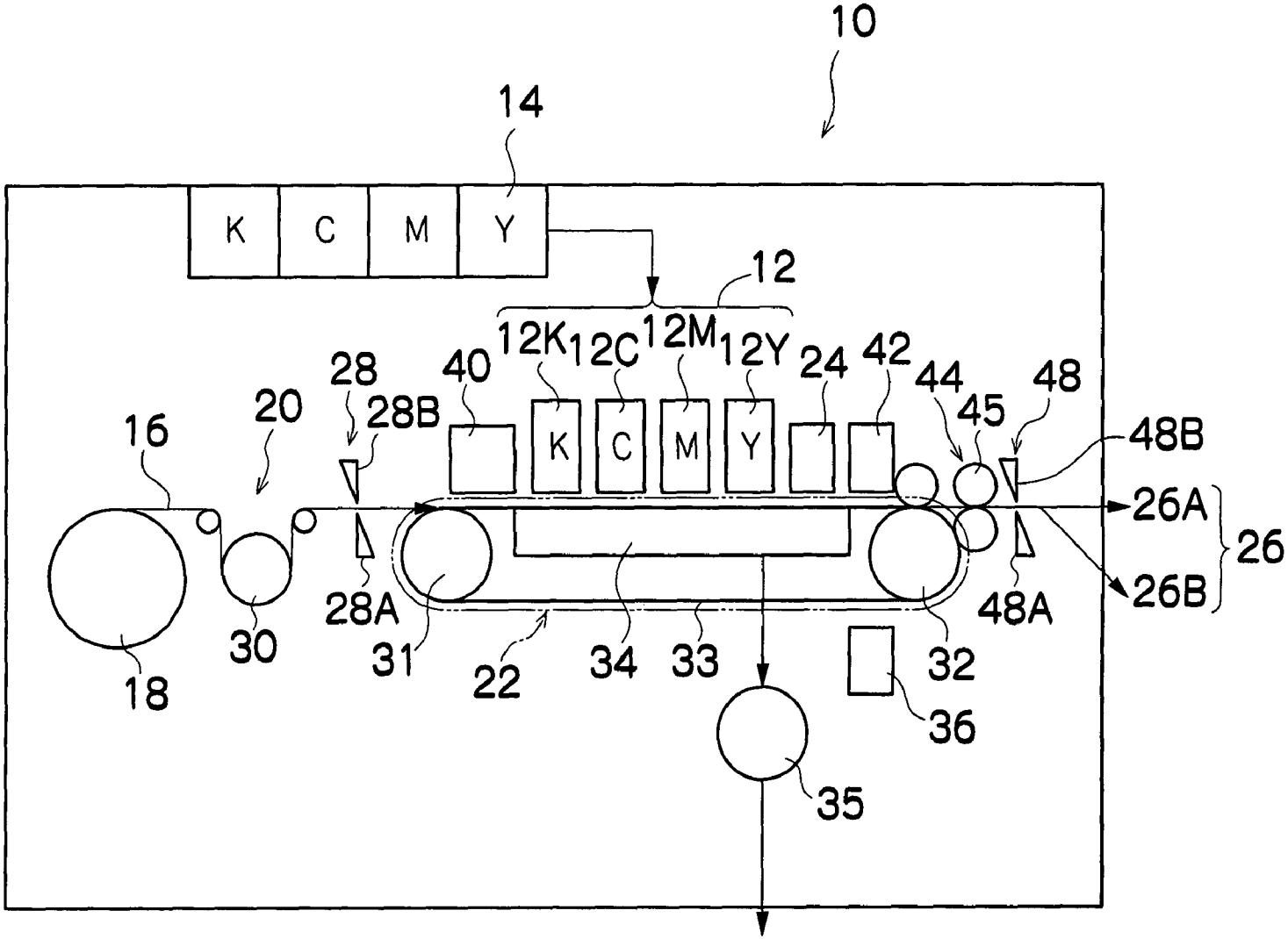
FIG. 1 is a general compositional view showing an embodiment of an inkjet recording apparatus using an inkjet head according to the present invention.

FIG. 1 is a general schematic drawing of an inkjet recording apparatus which forms an image forming apparatus according to the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. At this time, the heating temperature is preferably controlled in such a manner that the recording paper 16 has a curl in which the surface on which the print is to be made is slightly rounded in the outward direction.

After decurling, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane.

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of the suction belt conveyance unit 22, it might also be possible to use a roller nip conveyance mechanism, but since the printing area passes through the roller nip, the printed surface of the paper makes contact with the rollers immediately after printing, and hence smearing of the image is liable to occur. Therefore, the suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

The print unit 12 is a so-called "full line head" in which a line head having a length corresponding to the maximum paper width is arranged in a direction (main scanning direction) that is perpendicular to the paper conveyance direction (sub-scanning direction). The print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the main scanning direction.

Although a configuration with the KCMY four standard colors is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and, 12Y by means of channels (not shown). The ink storing and loading unit 14 has a warning device (for example, a display device or an alarm sound generator and the like) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor (line sensor).

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawing, the paper output unit 26A for the target prints is provided with a sorter for collecting prints according to print orders.

Structure of Print Head

Next, the structure of a print head is described. The print heads 12K, 12M, 12C, and 12Y of the respective ink colors have the same structure, and a reference numeral 50 is hereinafter designated to any of the print heads.

Figure 2:
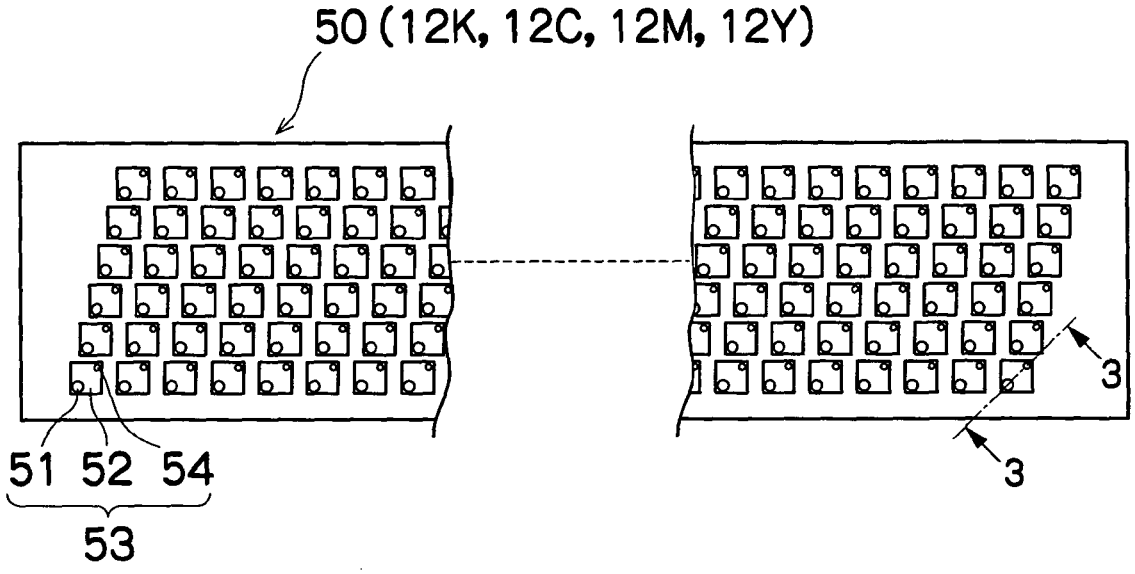
FIG. 2 is a plan perspective diagram showing an embodiment of the structure of a print head.
Figure 3:
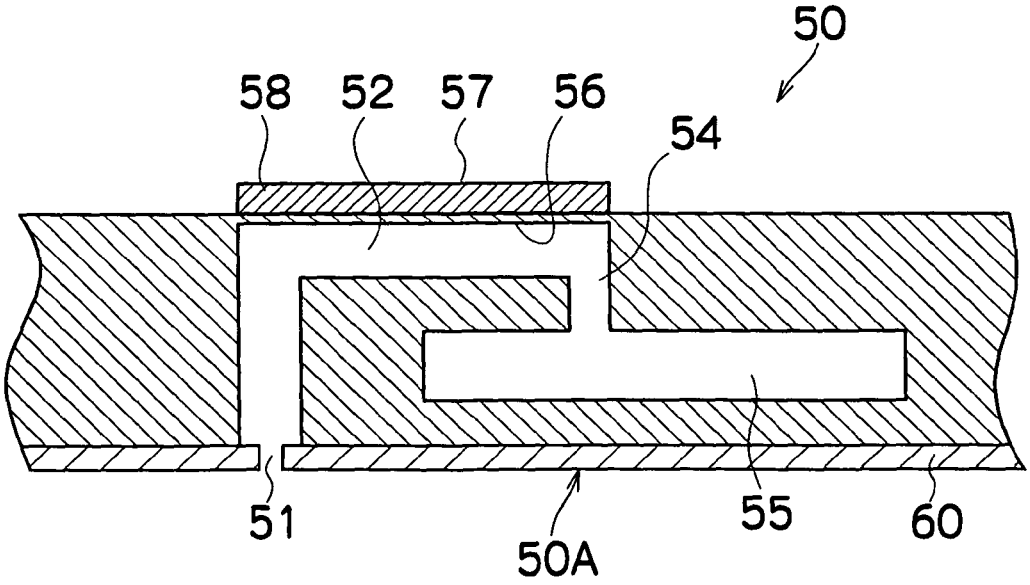
FIG. 3 is a cross-sectional diagram along line 3-3 in FIG. 2.

FIG. 2 is a perspective plan view showing an embodiment of the configuration of the head 50. FIG. 3 is a cross-sectional view taken along line 3-3 in FIG. 2, showing the inner structure of one of liquid droplet ejection elements (an ink chamber unit for one nozzle 51).

In order to maximize the resolution of the dots printed on the surface of the recording paper 16, the nozzle pitch in the head 50 should be minimized. As shown in FIG. 2, the head 50 according to the present embodiment has a structure in which a plurality of ink chamber units (droplet ejection elements) 53, each having a nozzle 51 forming an ink ejection port, a pressure chamber 152 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

As shown in FIG. 2, the planar shape of the pressure chamber 52 provided for each nozzle 51 is substantially a square, and the nozzle 51 and an inlet of supplied ink (supply port) 54 are disposed in both comers on a diagonal line of the square.

As shown in FIG. 3, the nozzle surface (ink ejection surface) 50A of the print head 50 is constituted by a nozzle plate 60 in which the nozzles (nozzle orifices) 51 are formed. The method of manufacturing the nozzle plate 60 is described later.

Furthermore, each pressure chamber 52 is connected through a supply opening 54 to a common flow channel 55. The common flow channel 55 is connected to an ink tank (not shown), which is a base tank that supplies ink, and the ink supplied from the ink tank is delivered through the common flow channel 55 to the pressure chambers 52.

An actuator 58 provided with an individual electrode 57 is joined to a diaphragm (common electrode) 56 which forms the upper face of each pressure chamber 52, and the actuator 58 is deformed when a drive voltage is supplied to the individual electrode 57 and the common electrode 56, and the volume of the pressure chamber 52 is changed, thereby causing ink to be ejected from the nozzle 51. The actuator 58 is preferably a piezoelectric element. When ink is ejected, new ink is supplied to the pressure chamber 52 from the common flow channel 55 through the supply port 54.

Figure 4:
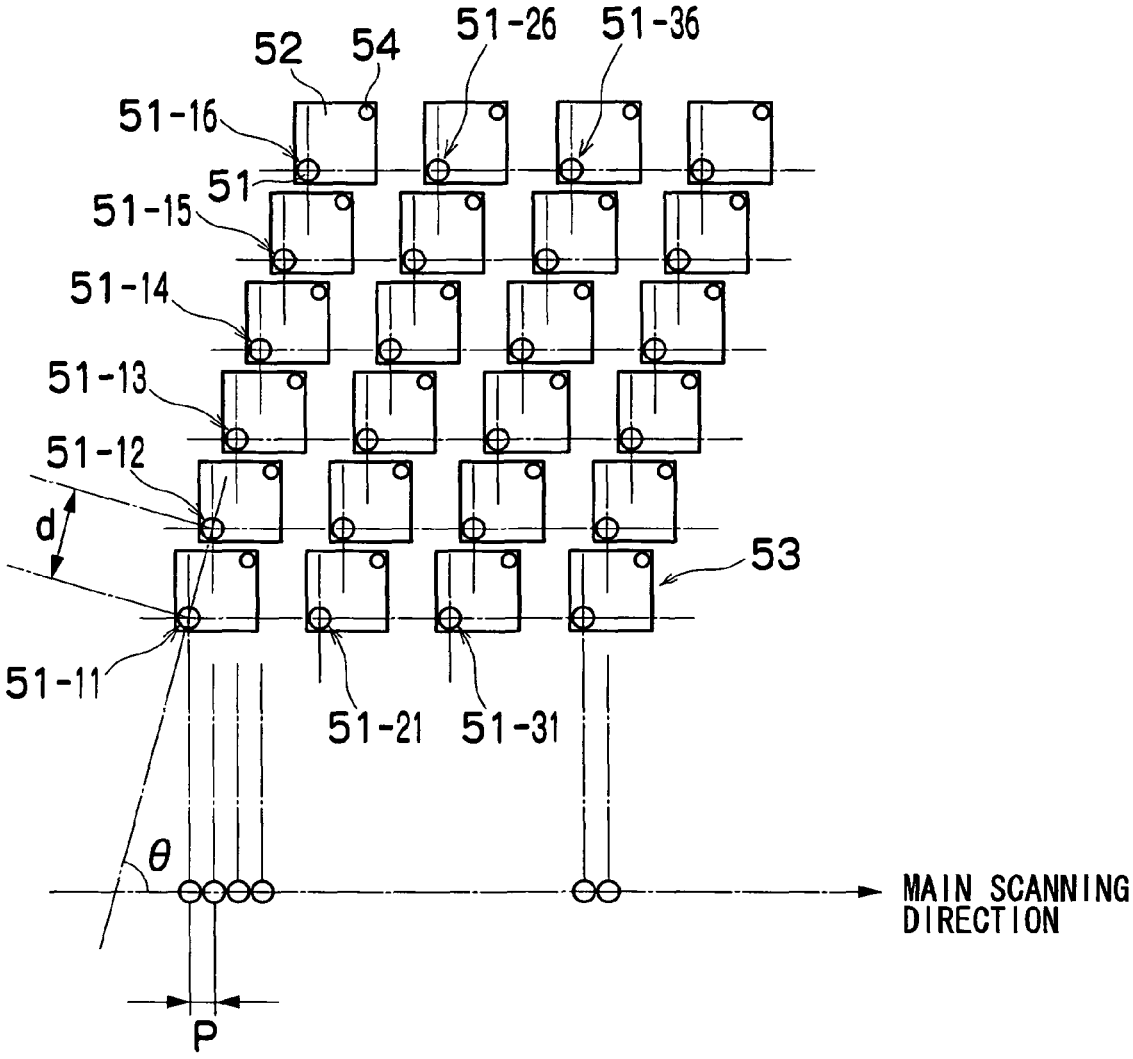
FIG. 4 is an enlarged view showing an embodiment of the nozzle arrangement in the print head shown in FIG. 2.

As shown in FIG. 4, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure in which a plurality of ink chamber units 53 are arranged at a uniform pitch d in a direction having an angle $\theta$ with respect to the main scanning direction, the pitch P of the nozzles projected so as to align in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles per inch).

In a full-line head comprising rows of nozzles that have a length corresponding to the entire width of the image recordable width, the "main scanning" is defined as printing one line or one strip in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 4 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

According to the present invention, the arrangement of the nozzles is not limited to that of the embodiment illustrated. Moreover, in the present embodiment, a method is employed wherein an ink droplet is ejected by means of the deformation of the actuator 58, which is, typically, a piezoelectric element, but in implementing the present invention, the method used for ejecting ink is not limited in particular, and instead of a piezo jet method, it is also possible to apply various other types of methods, such as a thermal jet method, wherein the ink is heated and bubbles are caused to form therein, by means of a heat generating body, such as a heater, ink droplets being ejected by means of the pressure of these bubbles.

Method for Manufacturing Nozzle Plate

FIGS. 5A to 5E are illustrative diagrams showing steps of manufacturing a nozzle plate 60. Below the method of manufacturing a nozzle plate 60 is described with reference to these diagrams.

Figure 5A:
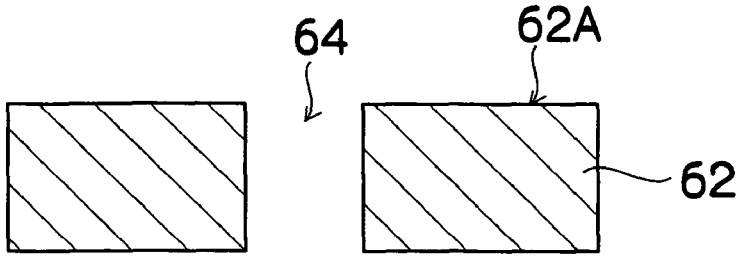
FIGS. 5A to 5E are illustrative diagrams showing steps for manufacturing a nozzle plate.

Firstly, as shown in FIG. 5A, preliminary holes 64, which are larger than the nozzle orifices (nozzles) 51, are formed by press forming, or the like, at the nozzle orifice forming positions in a nozzle forming substrate 62 made of stainless steel, nickel, resin, or the like. For example, the thickness of the nozzle forming substrate 62 is 50 μm to 100 μm, and the diameter of the preliminary holes 64 is 100 μm.

Figure 5B:
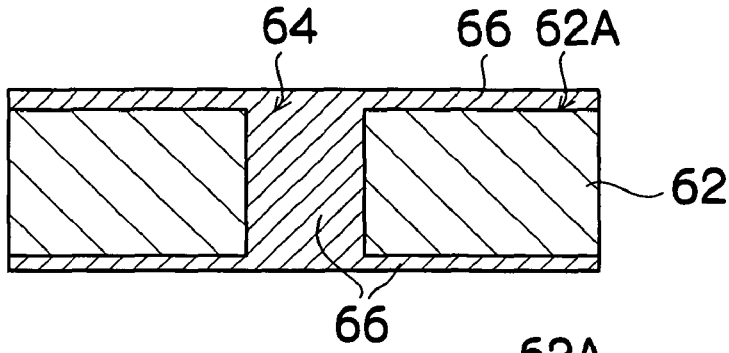
Figure 6A:
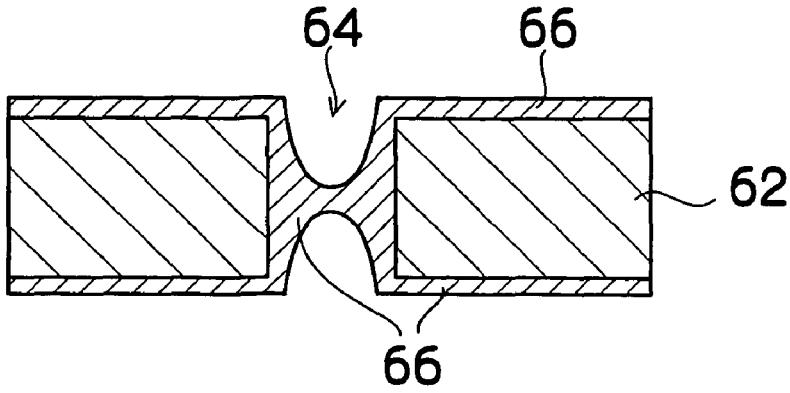
FIGS. 6A to 6C are partial side cross-sectional diagrams showing a nozzle forming substrate to which a liquid-philic agent has been applied.
Figure 6B:
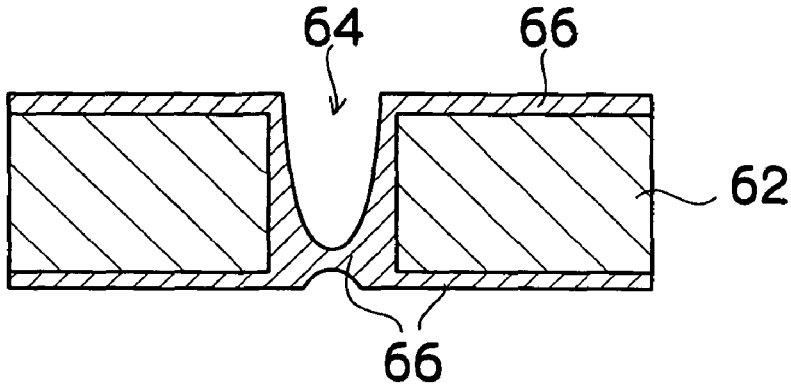
Figure 6C:
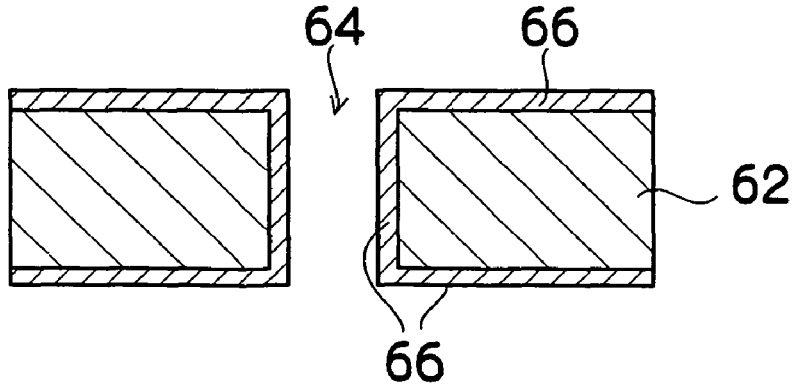

Next, as shown in FIG. 5B, a liquid-philic agent is applied to the whole surface of the nozzle forming substrate 62 and solidified by drying, or the like, thereby forming a liquid-philic film 66 on the front and rear surfaces of the nozzle forming substrate 62, and the preliminary holes 64. Desirably, the liquid-philic film 66 in the preliminary holes 64 is formed so as to completely fill the preliminary holes 64, as shown in FIG. 5B. Furthermore, as shown in FIGS. 6A and 6B, it is also possible to form the liquid-philic film 66 in such a manner that, as well as being disposed on the inner walls of the preliminary holes 64, the liquid-philic film 66 partially fills each preliminary hole 64. In this case, the thickness of the liquid-philic film 66 formed on the inner walls of the preliminary holes 64 is designed in such a manner that the diameter of the holes in the portion where the liquid-philic film 66 has been formed on the inner walls of the preliminary holes 64 is smaller than the diameter of the nozzle orifices 51 which are formed in a subsequent processing step. Desirably, the thickness of the liquid-philic film 66 formed on the inner walls of the preliminary holes 64 of the nozzle forming substrate 62 is 1 μm or above, taking account of the accuracy of the subsequent processing steps. If the preliminary holes 64 are in an open state as shown in FIG. 6C, rather than being blocked off by the liquid-philic film 66, then the liquid-philic agent is reapplied another time, or a viscosity enhancer is added to the liquid-philic agent, thereby making at least a portion of each preliminary hole 64 becomes blocked off by the liquid-philic film 66.

The liquid-philic agent is, for example, PHEMA (polyhydroxyethyl methacrylate), polysilazane, or a high-molecular-weight polymer containing silicon (Si) or silica ($SiO_2$). The method of applying the liquid-philic agent is desirably a dipping method, and alternatively, vapor deposition, spraying, bar coating, spin coating, or the like, may also be used.

In the present embodiment, a case where the liquid-philic film 66 is formed in the preliminary holes 64 and on the front and rear surfaces of the nozzle forming substrate 62 is described as a desirable mode, but the implementation of the present invention is not limited to this, provided that the liquid-philic film 66 is formed at least in the preliminary holes 64, as described above. If the liquid-philic film 66 is formed on the surface on the ink droplet ejection side (ink ejection surface) 62A of the nozzle forming substrate 62, then the formation of the liquid-philic film 66 is facilitated in comparison with a case where the liquid-philic film 66 is formed in the preliminary holes 64 alone. Furthermore, if the liquid-philic film 66 is formed on the rear surface on the opposite side to the ink ejection surface 62A, as in the present embodiment, then the formation of the liquid-philic film 66 is further facilitated.

Figure 5C:
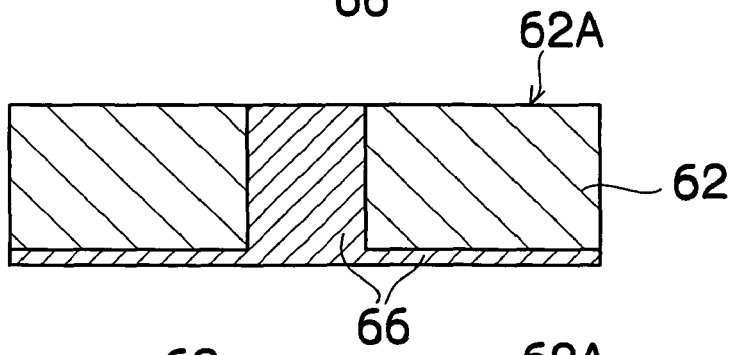

Next, as shown in FIG. 5C, the liquid-philic film 66 formed on the ink ejection surface 62A of the nozzle forming substrate 62 is removed by grinding. The step of removing the liquid-philic film 66 is performed in order to prevent non-uniformities in the thickness of a liquid-repelling film 68, which is formed in the next step (see FIG. 5D).

Furthermore, when removing the liquid-philic film 66, it is also possible to roughen the ink ejection surface 62A of the nozzle forming substrate 62 simultaneously, by grinding. This improves the adherence and the liquid repelling characteristics of the liquid-repelling film 68 formed in the next step.

Figure 5D:
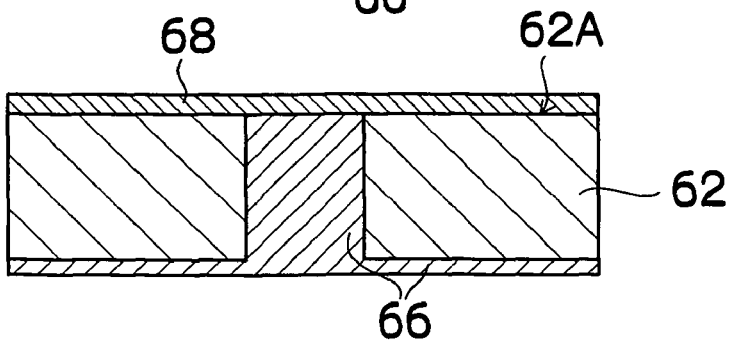

Next, as shown in FIG. 5D, a liquid-repelling agent is applied to the ink ejection surface 62A of the nozzle forming substrate 62, and solidified by drying, or the like, thereby forming the liquid-repelling film 68. For example, the liquid-repelling agent is made of polytetrafluoroethylene (PTFE), or a high-molecular-weight polymer containing fluorine (F). The method of applying the liquid-repelling agent is adhesion, dipping, spraying, bar coating, spin coating, or the like.

Figure 7A:
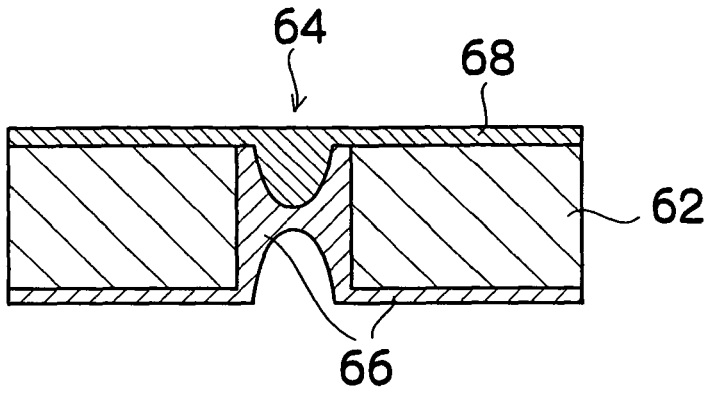
FIGS. 7A and 7B are partial side cross-sectional diagrams showing a nozzle forming substrate to which a liquid-repelling agent has been applied.
Figure 7B:
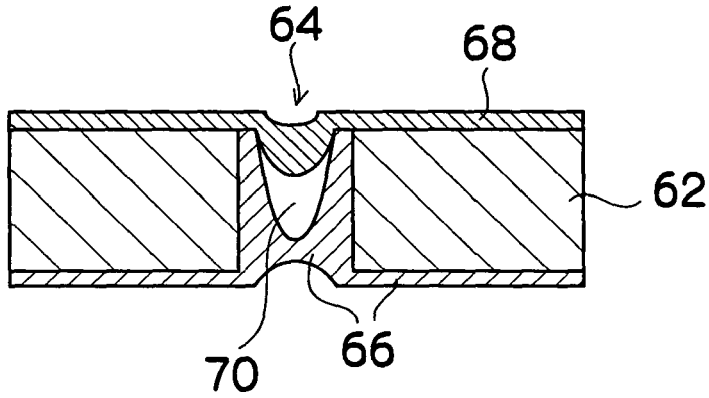

FIGS. 7A and 7B show embodiments of the application of the liquid-repelling agent in a case where the preliminary holes 64 are partially filled with the liquid-philic film 66 (see FIGS. 6A and 6B). In a case of this kind, the liquid-repelling film 68 may be formed by applying the liquid-repelling agent to the ink ejection surface 62A side of the liquid-philic film 66 that fills the preliminary hole 64, without forming any gap, as shown in FIG. 7A, or by applying the liquid-repelling agent in such a manner that a cavity section 70 is formed on the ink ejection surface 62A side of the liquid-philic film 66 that fills the preliminary holes 64, as shown in FIG. 7B.

Figure 5E:
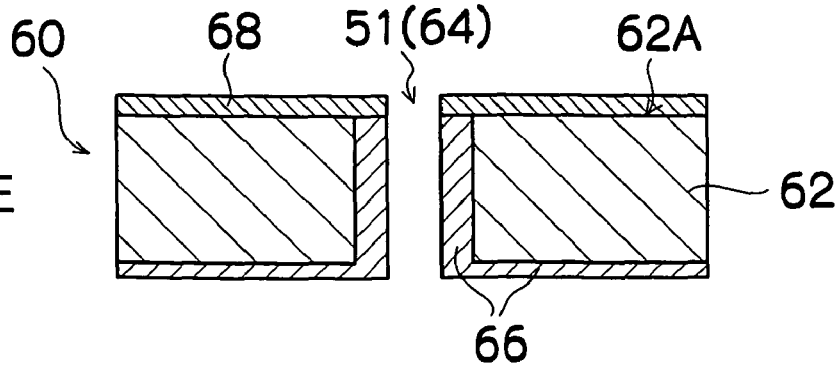

Next, as shown in FIG. 5E, the nozzle orifices 51 are formed through the portions of the preliminary holes 64 of the nozzle forming substrate 62 which have been filled with the liquid-philic film 66. The diameter of the nozzle orifices 51 is, for example, approximately 30 μm. The method of processing the nozzle orifices 51 is, for example, laser processing, micro-drilling, ashing using metal masks, blasting, and the like. In the case of ashing, it is desirable to process the nozzle orifices 51 from the side of the ink ejection surface 62A, which leads to good dimensional accuracy of the nozzle orifices 51. In the laser processing and the micro-drilling, there is no limitation in particular to the direction in which the nozzle orifices 51 are formed.

In this way, it is possible to manufacture the nozzle plate 60 in which the surface on the ink droplet ejection side is covered with the liquid-repelling film 68, while at the same time, the inner walls of the nozzle orifices 51 are covered with the liquid-philic film 66.

In the above-described method of manufacturing the nozzle plate 60, the liquid-philic film 66 is formed in the preliminary holes 64 of the nozzle forming substrate 62, whereupon the liquid-repelling film 68 is formed on the ink ejection surface 62A of the nozzle forming substrate 62, and the nozzle orifices 51 having a smaller diameter than the preliminary holes 64 are formed in the portions of the preliminary holes 64 filled with the liquid-philic film 66. In other words, by using the liquid-philic film 66 instead of resist, it is possible to manufacture the nozzle plate 60 in which the inner walls of the nozzle orifices 51 are covered with the liquid-philic film 66, without providing an additional liquid-philic treatment onto the inner walls of the nozzle orifices 51, and therefore the manufacturing steps are simplified. Furthermore, since no resist is used, then there is no occurrence of nozzle blockage as a result of residual resist inside the nozzle orifices 51.

Whereas it is generally difficult to process nozzle orifices 51 of very fine diameter to a high degree of accuracy in a nozzle forming substrate 62 made of a metal, such as stainless steel, in the method of manufacturing the nozzle plate 60 according to the present invention, since the nozzle orifices 51 are formed after forming the liquid-philic film 66 on the preliminary holes 64 having a larger diameter than the nozzle orifices 51, in the nozzle forming substrate 62, then it is possible to form the nozzle orifices 51 of a very fine diameter, with a high degree of accuracy.

Furthermore, the liquid-philic film 66 formed on the rear surface of the nozzle plate 60 on the side reverse to the ink droplet ejection side, can be used as an adhesive agent when bonding the nozzle plate 60 to another plate member. More specifically, since the nozzle plate 60 can be bonded to the other plate member without using adhesive, then there is no occurrence of nozzle blockage caused by surplus adhesive of the kind that arises when adhesive is used.

Figure 8:
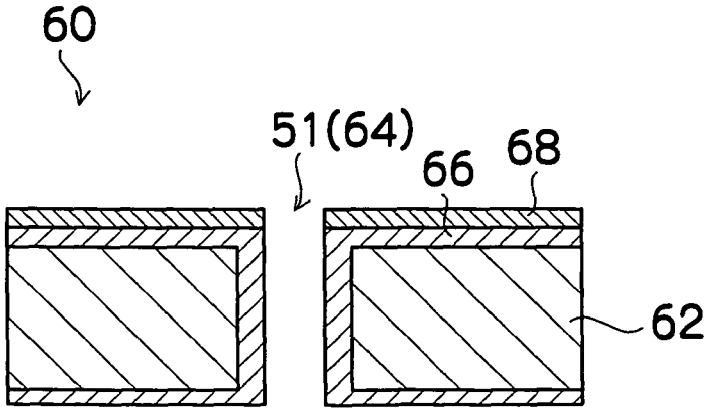
FIG. 8 is a partial side cross-sectional diagram of a nozzle plate in a case where the step of removing the liquid-repelling agent is omitted.

In the present embodiment, the liquid-philic film 66 formed on the ink ejection surface 62A of the nozzle forming substrate 62 is removed in the step shown in FIG. 5C, but if the thickness of the liquid-repelling film 68 can be made uniform in the subsequent step at FIG. 5D without removing the liquid-philic film 66, then the step in FIG. 5C can be omitted. FIG. 8 is a cross-sectional diagram showing a portion of a nozzle plate 60 manufactured in a case where the step in FIG. 5C is omitted. As shown in FIG. 8, in the nozzle plate 60 formed in the case where the step of removing the liquid-philic film 66 is omitted, the liquid-philic film 66 and the liquid-repelling film 68 are sequentially layered on the ink ejection surface 62A of the nozzle forming substrate 62. By omitting the step of removing the liquid-philic film 66 in this way, it is possible further to simplify the process of manufacturing the nozzle plate 60.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a nozzle plate having nozzle orifices for ejecting liquid droplets, the method comprising the steps of:

forming through holes in a nozzle forming substrate, each of the through holes passing through the nozzle forming substrate and having openings on a surface of a liquid droplet ejection side and a surface of a side opposite thereto of the nozzle forming substrate, the through holes having a larger diameter than the nozzle orifices;

forming a liquid-philic film on inner walls of the through holes to the extent that each of the through holes is at least partially filled with the liquid-philic film:

thereafter forming a liquid-repelling film on the surface of a liquid droplet ejection side of the nozzle forming substrate; and thereafter forming the nozzle orifices in each of the through holes that is at least partially filled with the liquid-philic film.

2. The method as defined in claim 1, further comprising the step of forming the liquid-philic film on the surface of the liquid droplet ejection side of the nozzle forming substrate before the step of forming the liquid-repelling film.

3. The method as defined in claim 2, further comprising the step of removing the liquid-philic film formed on the surface of the liquid droplet ejection side of the nozzle forming substrate, before the step of forming the liquid-repelling film.

4. The method as defined in claim 3, further comprising the step of roughening the surface of the liquid droplet ejection side of the nozzle forming substrate while removing the liquid-philic film.

5. The method as defined in claim 1, further comprising the step of forming the liquid-philic film on the surfaces of the liquid droplet ejection side and the other side of the nozzle forming substrate before the step of forming the liquid-repelling film.

6. The method as defined in claim 5, further comprising the step of removing the liquid-philic film formed on the surface of the liquid droplet ejection side of the nozzle forming substrate, before the step of forming the liquid-repelling film.

7. The method as defined in claim 6, further comprising the step of roughening the surface of the liquid droplet ejection side of the nozzle forming substrate while removing the liquid-philic film.

* * * * *